United States Patent [19]

Wang

[11] 4,238,299

[45] Dec. 9, 1980

[54] TUBING WITH COPPER-BORON CARBIDE COMPOSITE FACING AND METHODS FOR ITS PRODUCTION

[75] Inventor: Chih-Chung Wang, Lexington, Mass.

[73] Assignee: Kennecott Copper Corporation, New York, N.Y.

[21] Appl. No.: 69,525

[22] Filed: Aug. 24, 1979

[51] Int. Cl.[3] ..... C25D 15/00; C25D 7/04

[52] U.S. Cl. ..... 204/16; 204/25

[58] Field of Search ..... 204/16, 15, 25, 212

[56] References Cited

U.S. PATENT DOCUMENTS

| | | | |
|---|---|---|---|
| 1,079,427 | 11/1913 | Murphy | 204/212 |
| 1,535,400 | 4/1925 | Crowell | 204/212 |
| 3,046,204 | 7/1962 | Barron | 204/16 |
| 3,061,525 | 10/1962 | Grazen | 204/16 |
| 3,546,080 | 12/1970 | Iannone | 204/25 |
| 3,716,461 | 2/1973 | Ahmad | 204/16 |

*Primary Examiner*—T. Tufariello

*Attorney, Agent, or Firm*—John L. Sniado; Anthony M. Lorusso

[57] ABSTRACT

Metal tubing, preferably of square cross section, is employed as a cathode in an electrolytic cell. A layer of electrically nonconductive boron carbide particles is deposited on the surface of the tubing facing the anode and copper is electroplated through the layer of particles, following which the tubing is rotated to expose another face. In another system, tubes are arranged about the inner surface of a rotatable drum with a coaxial copper anode. The drum is filled with electrolyte and spun so that centrifugal force holds the boron carbide particles on the surfaces of the tubes and aids electrodeposition. Alternatively, a rotating cylindrical copper anode can be used with the tubing at the center.

24 Claims, 11 Drawing Figures

TUBING WITH COPPER-BORON CARBIDE COMPOSITE FACING AND METHODS FOR ITS PRODUCTION

BACKGROUND OF THE INVENTION

This invention relates generally to processes for manufacturing nuclear radiation shields containing boron carbide ($B_4C$) and, more particularly, to methods of economically producing tubing containing boron carbide particles embedded in a copper matrix. The primary use for shields of this general category is in fabrication of safe containers for storage, disposal, or transportation of nuclear waste materials and other radioactive substances which will become increasingly prevalent with greater reliance on nuclear energy. One of the known types of containers for nuclear waste materials comprises a plurality of cube-shaped boxes about 9" on a side. The 2—5 mm thick walls made of copper-boron carbide composites contain 20—50% boron carbide by weight. The boxes are embedded in alumunium which is poured (molten) around them and allowed to cool forming a cellular structure.

Boron carbide is the filler of choice because of its high capture cross-section for neutrons. However, absorption of neutrons by boron carbide produces heat. Copper is chosen for the matrix in which the boron carbide particles reside because copper's high specific heat and high thermal conductivity enables it to dissipate a large amount of heat with relatively low temperature rise. Aluminum, in comparison, is not as favorable and in addition has a lower melting point. It is not desirable to use aluminum alone.

The ideal boron carbide-filled copper plate material for use in fabricating these and other types of containers would be a substantially pure voidless matrix of copper metal tightly bonded to a uniformly dispersed boron carbide phase consisting of boron carbide particles arranged within the copper matrix such that no straight line passing through the plate fails to impinge upon a carbide particle. If there is too little copper, a product with voids and diminished structural integrity results. With too much copper the boron carbide particles are too sparsely distributed.

The different properties of boron carbide and copper present problems in fabricating boron carbide-filled copper. One process for manufacturing composite plates involving several separate procedures is described in copending U.S. Patent Application Ser. No. 901,843 entitled "Copper-Boron Carbide Composite and Method for Its Production", filed May 1, 1978, by C. C. Wang and assigned to the assignee of the present application. In one embodiment of the process, a film of electroless copper is bonded to the boron carbide. Next a relatively thick electrodeposited copper layer is applied to the film. Finally, the copper encapsulated particles are thermo-mechanically consolidated to produce shield structures by hot rolling or hot pressing, with or without sintering, with a copper to boron carbide volume ratio of 0.3—4.0, typically 1.0.

Boron carbide is commercially available in various particle sizes, for example, from the Carborundum Company of Niagra Falls, New York. The electrical resistivity of this material is on the order of $10^4$ to $10^8$ micro-ohms per centimeter. Electrodeposition does not usually lend itself to coating nonconductive materials.

SUMMARY OF THE INVENTION

The general object of the invention is to improve the fabrication of boron carbide-filled copper composite materials for nuclear waste containers and the like.

The specific object of the invention is to create a tube or shell having a continuous side wall containing a sufficient loading of boron carbide embedded in a heat dissipated matrix of metal such as copper such that radiation from within the tube is effectively absorbed in the wall. Tubing, preferably of square cross section, can be employed as a cathode in an electrolytic cell having a copper anode. A layer of electrically nonconductive boron carbide particles is deposited on the surface of the tube facing the parallel anode and a layer of copper is plated through the particle layer which becomes electrolytically entrapped in the growing composite. The tube is rotated to expose successive faces to the same treatment.

In another system, a plurality of parallel, contiguous circumferentially distributed tubes are arranged about the inner circumference of a rotatable drum having a coaxial central copper anode. Centrifugal force holds the carbide particles on the exposed faces of the tubing and, at high rotation rates, aids electrodeposition. Alternatively, tubing can be placed coaxially in the center of a slowly rotating copper anode drum. Boron carbide particles introduced into an electrolyte within the drum are circulated and fall upon the surface of the tubing while plating proceeds.

DETAILED DESCRIPTION

Figure 1:
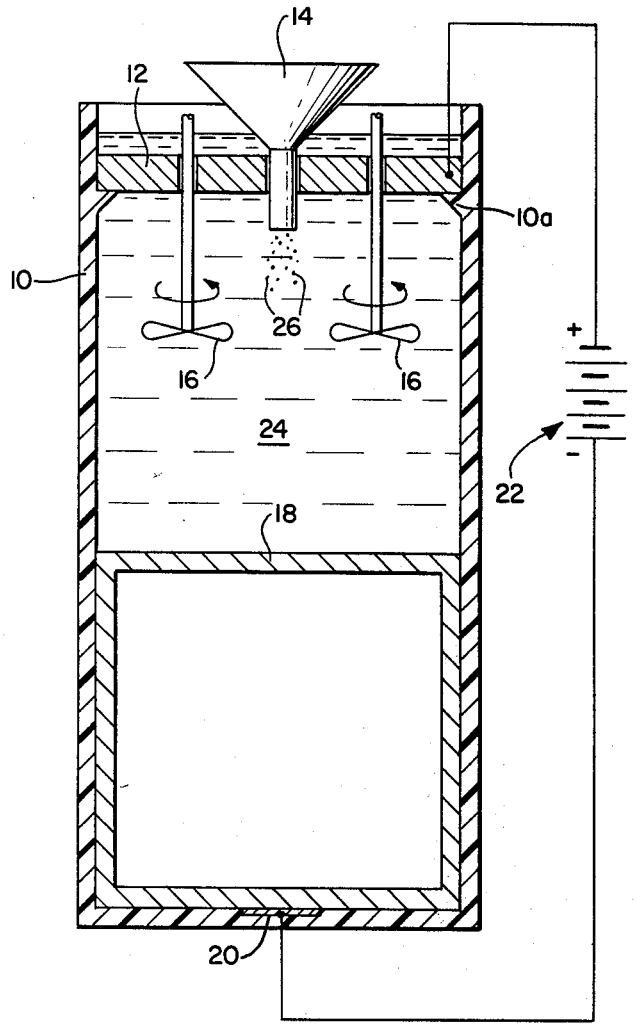
FIG. 1 is a schematic sectional view of an electrolytic cell for plating a square tube according to the invention.

In FIG. 1 an open box-shaped, vertical electrolytic cell 10 is made of a polyacrylic ester, such as that sold under the trademark LUCITE, or another chemically nonreacting electrically non-conductive material. The side walls of the cell 10 include integral supports 10*a* for a metal anode 12 which is preferably a phos-deoxidized, apertured copper plate approximately co-extensive with the horizontal cross-section of the cell. The anode 12 is fitted with at least one built-in funnel or hopper 14 received through a corresponding opening in the anode. Distributed around each funnel 14 are a plurality of manual or motor-driven stirrers 16. Depending on the length of the cell in the direction perpendicular to FIG. 1, it may be necessary to include several sets of funnels and stirrers to accommodate the entire cross-sectional area of the cell. An elongated hopper or slit opening can be used instead of funnels 14. A removable metal tube 18 is placed on the bottom of the cell 10 in electrical contact with cathode contact 20. Anode 12 and cathode contact 20 are connected to corresponding terminals of a direct current source 22.

Figure 2A:
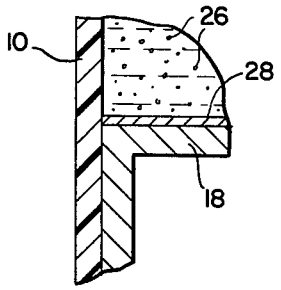
FIGS. 2*a*—2*d* are schematic fragmentary sectional views in the same plane as that of FIG. 1 showing four successive stages in the electrodeposition process with the cell of FIG. 1.
Figure 2B:
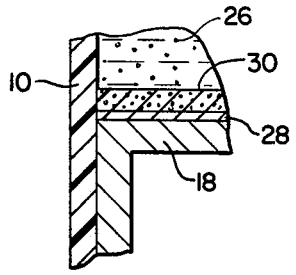
Figure 2C:
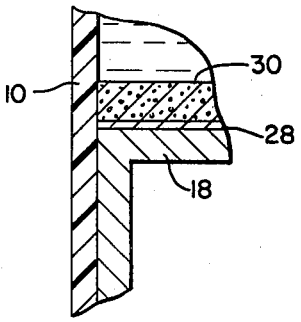
Figure 2D:
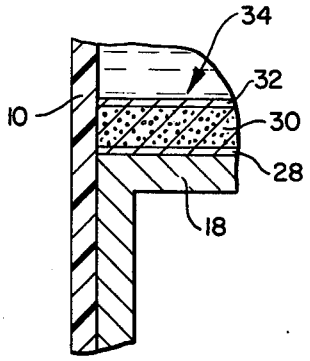

The tube 18, shown in cross-section in FIG. 1, is preferably made of square stainless steel tubing. The configuration of the bottom of the cell 10 is such that the tube is removably situated in the bottom of the cell with one upper horizontal side facing the parallel anode 12 above. The entire cell 10 is filled to a level above the anode 12 with conventional copper electrolyte solution 24 containing copper ions, for example, an aqueous solution of copper sulphate and sulfuric acid. Unprecoated electrically nonconductive boron carbide particles 26 are introduced through the funnel 14 while agitating the electrolyte with the stirrers 16. As shown in FIG. 2*a*, while (or before) the carbide particles 26 are being dispersed in the electrolyte, preferably a thin layer 28 or film of pure copper is plated on the exposed upper surface of the tube 18 to improve the bonding between the stainless steel tube 18 and the composite layer to be built-up on its surface. After the uniform suspension phase, illustrated in FIG. 2*a*, the stirrers 16 are stopped to allow the particles 26 to settle onto the surface of the tube 18 while electroplating proceeds. As shown in FIG. 2*b*, as the copper level rises, particles 26 become entrapped in the growing composite layer 30. Electroplating proceeds in FIG. 2*c* until substantially all of the particles 26 have been incorporated, at which point a finish coat 32 of pure copper may be applied by continuing the electroplating at higher current density if desired, as shown in FIG. 2*d*. The result is a copper-boron carbide facing or coating 34 (greatly exaggerated in size in the drawing for clarity) on the exposed face of the tube 18.

A preferred technique is to add a little boron carbide at a time, for example, by adding about 10% of the total weight of boron carbide stirring slowly for one minute and then stopping stirring to allow the particles to settle for just over an hour, (e.g. 80 minutes) between carbide additions. The plating current may remain on or off for the brief interval coinciding with each subsequent addition of boron carbide particles and agitation of the electrolyte.

Other examples of the electrolytic entrapment technique employed herein are disclosed in copending U.S. Applications Ser. Nos. 069,263 and 069,526 by Wang and Wilder, respectively, filed on the same day and assigned to the same assignee as this application, both of which are incorporated herein by reference in their entirety.

Figure 3:
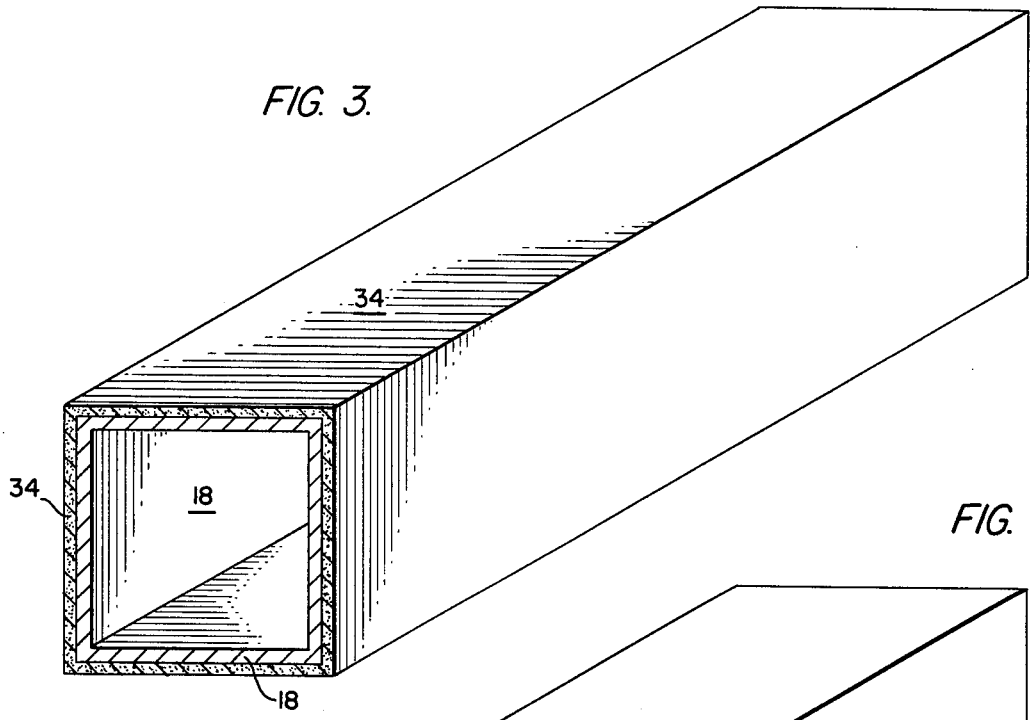
FIG. 3 is a schematic isometric view of the product of the cell of FIG. 1.
Figure 4:
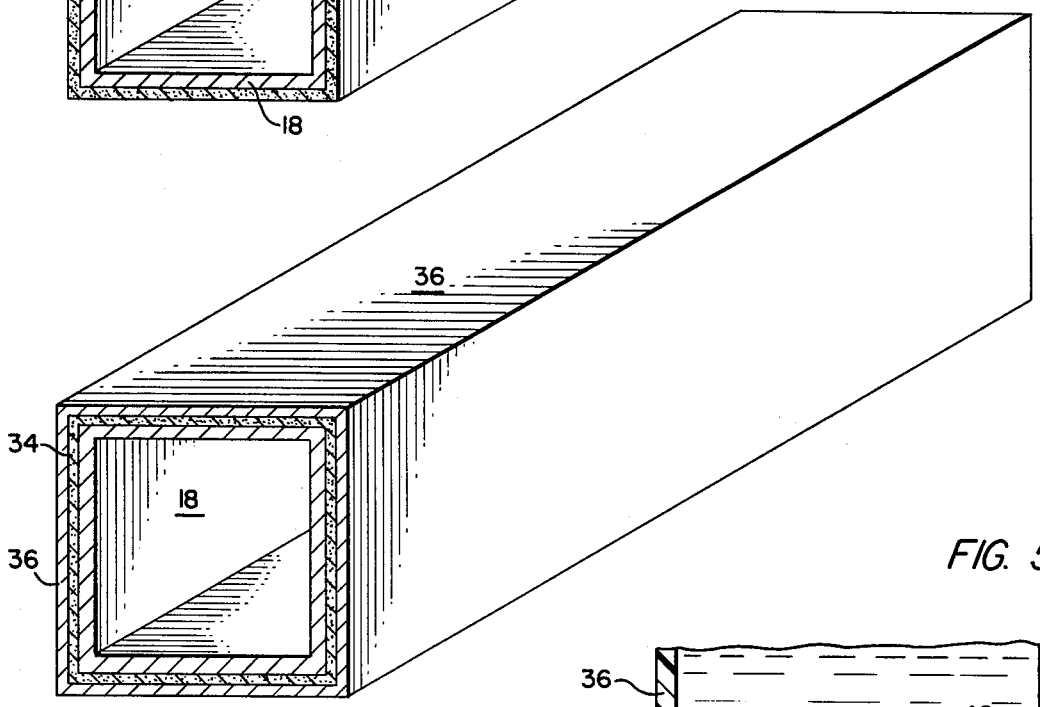
FIG. 4 is a schematic isometric view similar to that of FIG. 3 of the product of the cell of FIG. 1 with an additional outer casing.

Having prepared the outer coating 34 on one of the faces of the tube 18, the tube is next removed from the cell, if necessary, and rotated 90° to present the next face for the same coating treatment. Note that the width of the cell 10 must be sufficient to accommodate the width of the tube plus the coating. The finished product as shown in FIG. 3 includes a composite facing 34 surrounding the stainless steel tube 18. The parallel edges of the facing 34 are shown in somewhat idealized form; in practice they will be rougher and less well defined. If desired, the copper boron carbide-clad square tube shown in FIG. 3, can be encased in stainless steel tubing or sleeve 36 for further durability and strength.

Figure 5:
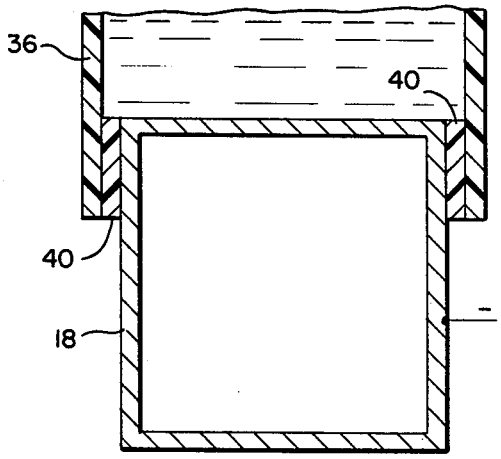
FIG. 5 is a schematic fragmentary sectional view of a modification of the floor of the cell of FIG. 1 allowing the exposed face of the square tube to form the bottom of the cell.

In FIG. 5, an alternate embodiment, the cell 38 employs the tubing 18 itself as the bottom of the cell with sealing means 40 between the parallel side walls of the tubing 18 and adjacent walls of the cell 38. The process is carried out in substantially the same manner rotating the tube 18, 90° to plate successive faces. Since a portion of the tube 18 is suspended from the cell 38, the exposed wall can be connected directly to the direct current source.

Figure 6:
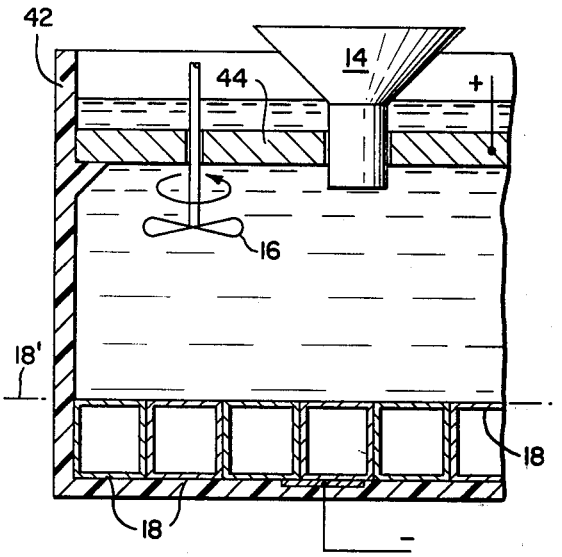
FIG. 6 is a partial schematic sectional view of a cell similar to that of FIG. 1 containing a plurality of tubes.

Another variation of the process described in connection with FIG. 1 is shown in FIG. 6 in which a cell 42 accommodates a plurality of identical square tubes 18 arranged in the bottom of the cell 42 in parallel side-by-side so as to present their upper faces in one plane 18' below and parallel to the copper anode 44. The process is carried out in the same manner in the cell of FIG. 6. After plating one side of each of the tubes 18, each tube is rotated 90° to expose the next corresponding face in the same plane 18', the end product being a plurality of coated tubes of the type shown in FIG. 3.

In certain applications it may not be necessary to plate the total exposed surface area of the tube. For example, it may be necessary to coat only 3 sides, where square tubes are used side-by-side in pairs. The tubes themselves may be missing a side, for example, to provide a U-shaped cross-section so that a pair can be joined to make an enclosure, and the term "tubing" used herein is hereby defined to include partially closed elongated shells of this kind.

Figure 7:
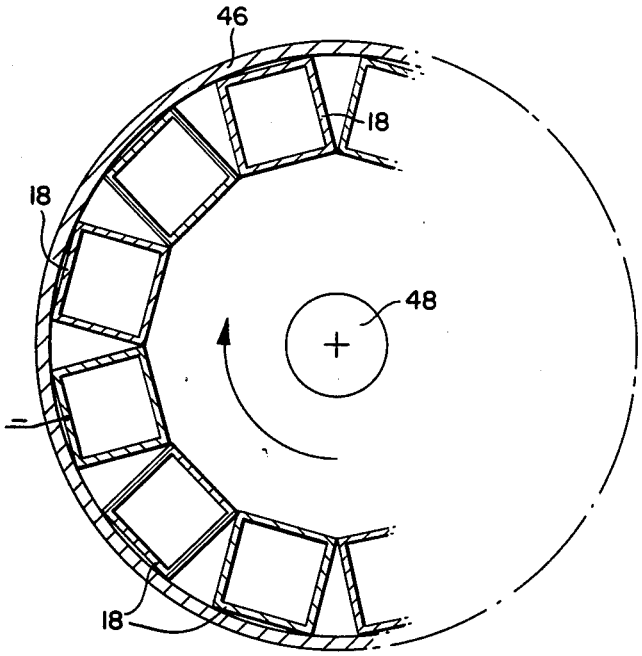
FIG. 7 is a partial schematic cross-sectional view of another tube-coating process in which tubes are arranged inside a rotating cathode drum.

FIG. 7 illustrates another arrangement for coating square tubing with a composite layer, in which gravity is augmented by artificial acceleration. A plurality of square tubes 18 (shown in cross-section in FIG. 7) are arranged contiguously around the inner circumference of a rotatable drum 46. A coaxial copper anode 48 is centrally located within the drum. The adjacent sides of the tubes 18 collectively present a polyhedral or segmented approximation of a cylindrical surface. The interior of the drum is filled with electrolyte containing copper ions and the tubes 18 are electrically connected to the negative terminal of the direct current source through a conventional commutator device (not shown). Electrically nonconductive boron carbide particles are introduced into the electrolyte within the drum 46 and spread evenly over the exposed surfaces of the tubes 18. This even distribution is achieved by first slowly rotating the assembly and then increasing the rotational speed gradually until the boron carbide particles settle evenly on the inside surface of the drum. The optimum rate of the increase of the rotational speed for even distribution of the particles depends upon the drum diameter and the amount and size of the particles. After a uniform particulate layer is obtained, the drum is rotated rapidly about its axis while electroplating copper onto the exposed faces of the tubes through the particulate layer. The artificial gravitational (G) force produced by the centrifugal force aids the electrodeposition process. The higher the G force, the more beneficial it will be, and, is limited only by the capability of the equipment. As with the cells of FIGS. 1, 5, and 6, the boron carbide particles become electrolytically entrapped in a growing layer of copper. After coating one face of each tube simultaneously, each tube is rotated 90° to expose the next corresponding face. The process is repeated until the desired number of faces of the tubes 18 are plated with the composite. If desired before adding the carbide particles, a thin layer or film of pure copper can be applied to the faces of the tubes by electrodeposition.

Figure 8:
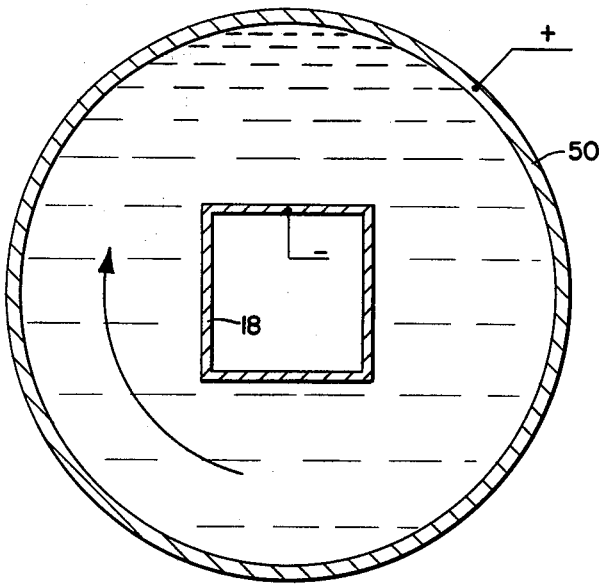
FIG. 8 is a schematic cross-sectional view of another tube-coating process in which a single tube is centrally located within a rotating anode drum.

FIG. 8 illustrates still another arrangement employing the electrolytic entrapment technique to build a composite layer on a square tube. The tube 18 is mounted coaxially at the center of a rotatable drum 50 having at least a copper inner surface serving as the anode. The drum is filled with electrolyte containing copper ions. Electrically nonconductive boron carbide particles are introduced into the electrolyte while the drum rotates at a rate such that the centrifugal force at the drum 50 is less than twice that of gravity such that the particles will not settle on the inside surface of the drum. The tube 18 is mounted to rotate with the drum 50. As the drum rotates, the electrolyte is induced to rotate through drag forces such that the carbide particles also circulate and fall evenly onto the outside surfaces of the square tubing continuously. At the same time, plating current is passed between the anode drum 50 and the cathode tube 18 such that copper is plated onto the outside surface of the tube 18 electrically entrapping the particles as they settle randomly onto the surface of the tube. The arrangement of FIG. 8 differs from those in the preceding figures in that all of the outer surface of tube 18 is plated at once rather than one face at a time as in the other methods. On the other hand, if one or more surfaces are preferred not to be coated, it can be carried out by simply placing a chemically stable non-conducting layer (such as a self-sticking Teflon tape) onto these surfaces beforehand.

Accordingly, a variety of electrolytic cell arrangements can be employed to plate the outside surface of metal tubing with a composite facing layer of copper and boron carbide. The coated tubes made in accordance herewith can be used for the fabrication of low cost, safe containers for radioactive material so that nuclear waste, in particular, can be transported, stored, and disposed of without endangering the environment.

The invention may be embodied in other specific forms without departing from the spirit or essential characteristics thereof. The present embodiments are therefore to be considered in all respects as illustrative and not restrictive the scope of the invention being indicated by the appended claims rather than by the foregoing description, and all changes that come within the meaning and range of equivalency of the claims are therefore intended to be embraced therein.

I claim:

1. A method of coating tubing with a layer of boron carbide embedded in copper, comprising the steps of:

providing an electrolyte containing copper ions in contact with the surface of the tubing to be coated;

depositing a layer of electrically nonconductive boron carbide particles through the electrolyte onto a portion of the outer surface of metal tubing in contact with the electrolyte containing copper ions;

electrolytically depositing copper onto said outer surface of said tubing through said layer of nonconductive particles to build up an electrodeposited copper matrix substantially filling spaces between the nonconductive boron carbide particles deposited on said surface; and rotating said tubing and repeating the preceding depositing steps at another portion of the outer surface of said tubing.

2. The method as set forth in claim 1, further including the step of repeating the preceding step until substantially the entire outer surface of said tubing is coated with the composite layer of copper-boron carbide.

3. The method as set forth in claim 1, wherein said tubing consists of a single tube.

4. The method as set forth in claim 1, wherein said tubing consists of a plurality of tubes.

5. The method as set forth in claim 1, wherein said tubing has a polygonal cross-section.

6. The method as set forth in claim 1, wherein said tubing has a rectangular cross-section.

7. The method as set forth in claim 1, wherein said tubing has a square cross-section.

8. The method as set forth in claim 1, wherein each rotating step is done in a 90° increment.

9. The method as set forth in claim 1, further including augmenting gravity by artificial acceleration while depositing copper.

10. The method as set forth in claim 1, wherein the depositing of said particles is accomplished with the aid of centrifugal force.

11. The method as set forth in claim 1, wherein the depositing of copper is accomplished with the aid of centrifugal force.

12. The method as set forth in claim 1, further including as a final step, encasing the coated tube in a metal sleeve.

13. The method as set forth in claim 12, wherein said metal sleeve is made of stainless steel.

14. The method as set forth in claim 1, further including the step of applying an initial layer of copper on said portion of the outer surface of said tubing prior to depositing said particles.

15. The method as set forth in claim 1, further including the step of applying a final layer of copper over the composite layer of copper-boron carbide.

16. The method as set forth in claim 1, further including the step of:

for each given portion of the surface of said tubing, repeating the steps of depositing the particles and electro-depositing copper until the built-up composite layer attains a predetermined thickness.

17. An electroplating method, comprising the steps of:

providing a cell with two depending parallel walls defining an elongated lower opening and an anode parallel to said opening;

sealingly inserting a tube of square cross section between said walls in said opening parallel to said anode to form the bottom of said cell and plating cathode;

adding electrolyte containing metal ions to said cell in contact with the anode and the upper surface of said tube; and plating metal onto the upper surface of said tube.

18. The electroplating method of claim 17 further including the step of removing, rotating said tube by a multiple of 90° and reinserting said tube in said opening parallel to the anode so as to expose another face of the tube; and repeating the plating step.

19. The method as set forth in claim 17, further including the step of:

depositing electrically nonconductive particles on the upper surface of said tube before plating and then plating through the layer of particles to electrolytically entrap the particles in a metal matrix bonded to the upper surface of said tube.

20. A method of electroplating a plurality of tubes with augmented gravitational forces, comprising the steps of:

placing a plurality of tubes around the inside surface of a drum parallel to its axis such that adjacent surfaces of said tubes facing the axis of the drum form a segmented approximation of a cylindrical surface;

placing a metal anode at the center of the drum extending axially coextensively with the tubes;

filling the drum with an electrolyte containing metal ions; and plating metal onto said adjacent surfaces of said tubes simultaneously while rotating said drum to aid electrodeposition by means of centrifugal force.

21. The method as set forth in claim 20 further comprising the step of:

introducing a batch of electrically non-conductive particles into said electrolyte while rotating said drum and spreading said particles in a uniform layer about said adjacent surfaces of said tubes and then plating metal through said layer.

22. The method as set forth in claim 19, or 21, wherein said metal is copper and said particles are boron carbide.

23. A method of electroplating tubing with a composite layer, comprising the steps of:

placing metal tubing at the center of a rotatable drum having at least a metal inner surface;

filling the drum with an electrolyte containing metal ions;

introducing a batch of loose electrically non-conductive particles into the electrolyte and rotating said drum such that said particles circulate about the axis of said drum and said tube and fall upon the surfaces of said tube while plating metal onto said tube so that said particles are electrolytically entrapped in growing composite layers.

24. The method as set forth in claim 23, wherein said metal is copper and said particles are boron carbide.

* * * * *